US005807081A

United States Patent [19]

Schutte et al.

[11] Patent Number: 5,807,081

[45] Date of Patent: Sep. 15, 1998

[54] COMBINATION VALVE FOR SCREW COMPRESSORS

[75] Inventors: Peter T. Schutte, Syracuse; Stanley R. Grant, Baldwinsville, both of N.Y.; Michael G. Field, Groton, Mass.

[73] Assignee: Carrier Corporation, Syracuse, N.Y.

[21] Appl. No.: 775,999

[22] Filed: Jan. 6, 1997

[51] Int. Cl.[6] ..... F04B 49/00

[52] U.S. Cl. ..... 417/309; 417/308; 417/301; 417/310; 137/493.3; 137/493.6

[58] Field of Search ..... 417/301, 308, 417/309, 310; 137/493.3, 493.6, 493.9

[56] References Cited

U.S. PATENT DOCUMENTS 4,560,330 12/1985 Murayama et al. ..... 418/55

5,125,323 6/1992 Yonezawa ..... 137/493.3

FOREIGN PATENT DOCUMENTS 1285733 8/1972 United Kingdom ..... 137/493.3

*Primary Examiner*—Charles G. Freay
*Assistant Examiner*—Cheryl J. Tyler

[57] ABSTRACT

Normally closed valve structure is located in a fluid path between the suction and discharge sides of a compressor. The valve structure opens upon a small pressure differential when the higher pressure is in the normal suction side which is indicative of reverse operation. Additionally, relief valve structure opens when the discharge pressure becomes excessive.

11 Claims, 3 Drawing Sheets

COMBINATION VALVE FOR SCREW COMPRESSORS

BACKGROUND OF THE INVENTION

Rotary compressors can run in reverse due to pressure equalization taking place through the compressor at shut down as well as due to phase reversal or misfiring. If the reverse operation is due to pressure equalization, the compressor, which would be acting as an expander, would only be able to run in reverse as long as there is motive power in the form of pressurized gas. Normally, the amount of compressed gas available as motive power is the volume in the pump structure and between the pump structure and a check valve in the discharge line which limits the amount of motive power for reverse operation. In the case of phase reversal or misfiring, the compressor acts as a suction pump with the discharge line check valve preventing the feeding of gas to the suction of the reverse operating device. The device keeps drawing a deeper vacuum, the normal lubrication is disrupted and failure is usually the only mechanism for stoppage. In normal operation, the trapped compressed volume of gas is delivered to the discharge line but the pressure must be built up to the pressure in the discharge line for discharge to take place. If, for example, there is a blockage in the discharge line, the trapped gas may have to be compressed to too great of a pressure and cause damage to the device due to the excess pressure in the pump structure.

SUMMARY OF THE INVENTION

A combination valve is provided between the suction and discharge sides of a compressor. Normally both valves are biased closed. The reverse operation triggered valve opens under a relatively small pressure differential when the normal discharge side is at a lower pressure than the normal suction side which is a condition of reverse operation. The relief valve will only open when the pressure differential from the discharge side to the suction side exceeds a predetermined differential.

It is an object of this invention to permit screw compressors to endure acceptable periods of reverse operation.

It is a further object of this invention to reduce reverse thrust loads and to thereby lessen contact forces between the rotors and housings of screw compressors during reverse operation.

It is another object of this invention to prevent screw compressors from seizing and/or to increase the time to failure due to reverse operation. These objects, and others as will become apparent hereinafter, are accomplished by the present invention.

Basically, normally closed valve structure is located in a fluid path between the suction and discharge sides of a compressor. The valve structure opens upon a small pressure differential when the higher pressure is in the normal suction side which is indicative of reverse operation. Additionally, relief valve structure opens when the pressure differential from the discharge side to the suction side exceeds a predetermined differential.

BRIEF DESCRIPTION OF THE DRAWINGS

For a fuller understanding of the present invention, reference should now be made to the following detailed description thereof taken in conjunction with the accompanying drawings wherein.

Description of the Preferred Embodiment

Figure 1:
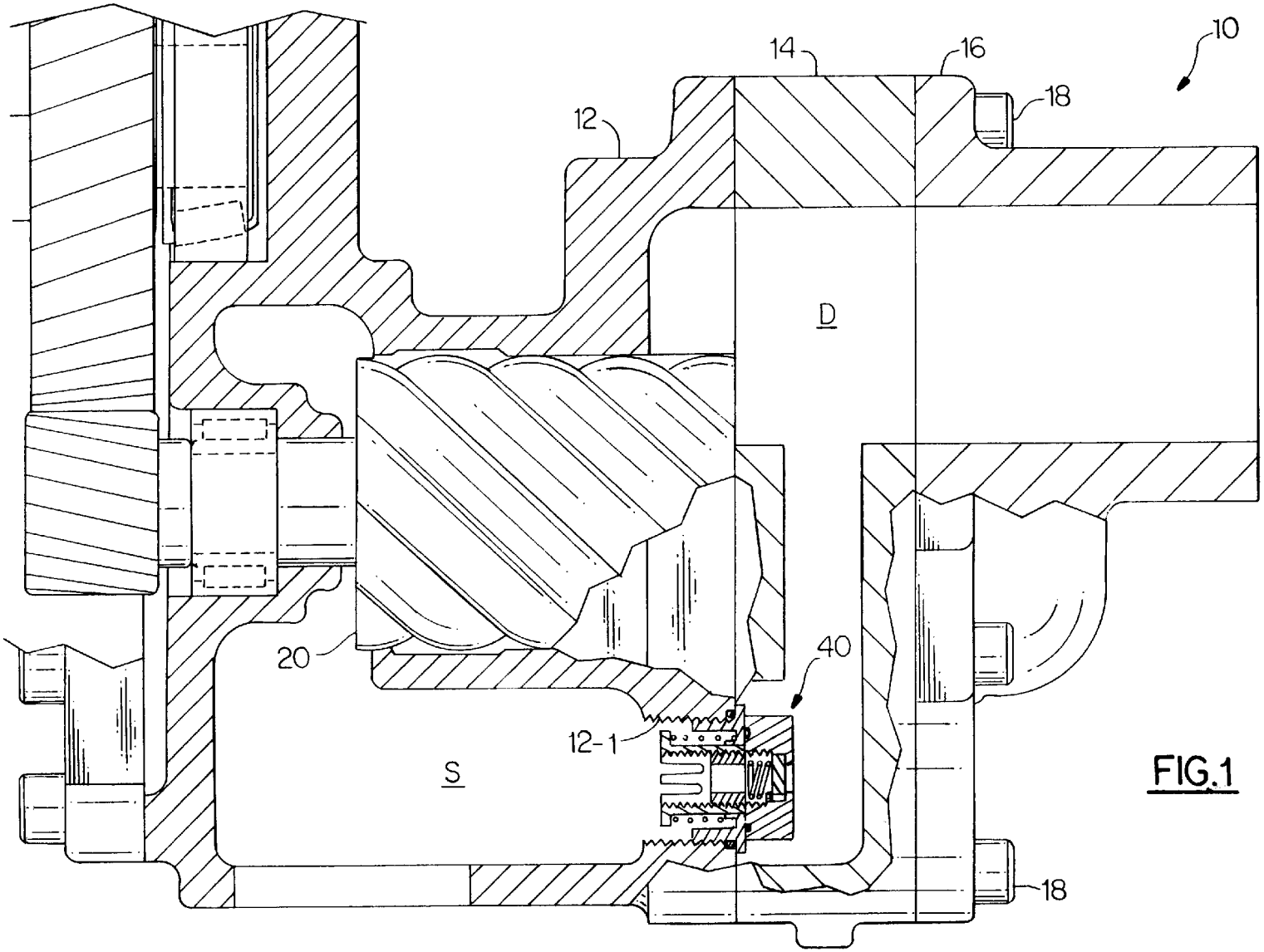
FIG. 1 is a partial, partially sectioned view of a screw compressor employing the present invention.

In FIG. 1 the numeral 10 generally designates a twin rotor screw compressor having a male rotor 20 and a female rotor (not illustrated). The rotors are located in rotor housing 12. Outlet casing 14 is secured to the discharge side of rotor casing 12 and bearing casing 16 is secured on the other side of outlet casing 14. Rotor casing 12, outlet casing 14, and bearing casing 16 are suitably secured together as by bolts 18. Compressor 10 has a suction plenum S and a discharge plenum D. Normally communication between the suction plenum S and discharge plenum D is through the pump structure defined by the rotors and associated structure. The structure described to this point is generally conventional. The present invention adds threaded bore 12-1 in rotor casing 12 to connect suction chamber S with discharge chamber D. Valve assembly 40 is secured in bore 12-1 and normally prevents flow between suction chamber S and discharge chamber D via bore 12-1.

Figure 2:
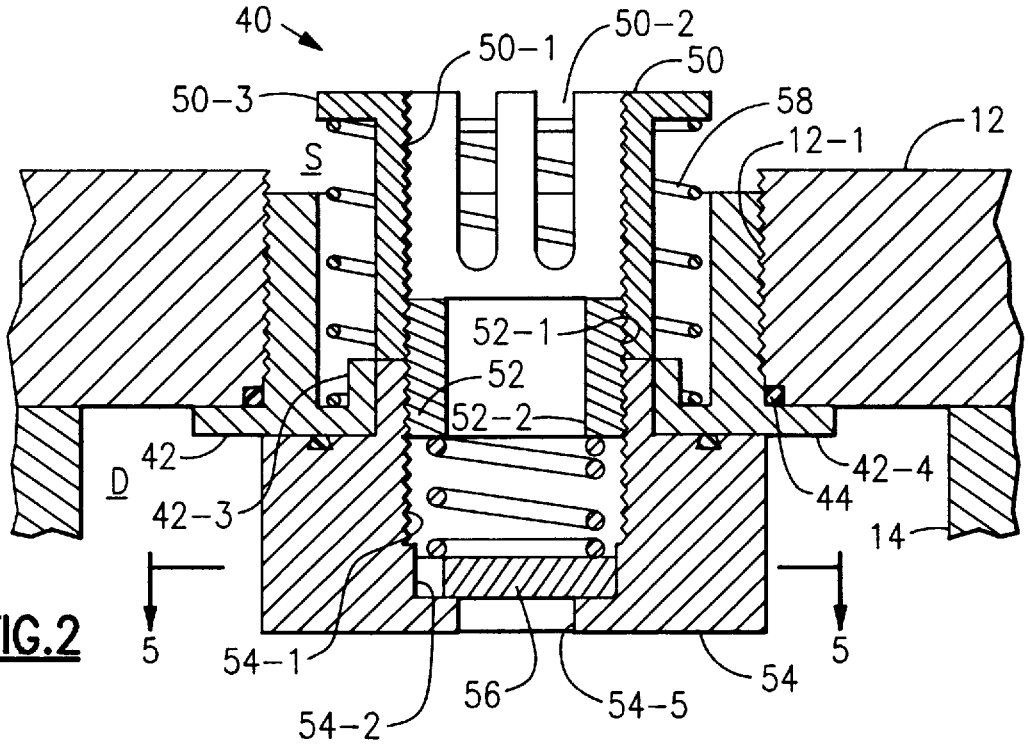
FIG. 2 is a sectional view showing the valve structure of the present invention in its normal, closed position.

Referring to FIG. 2, valve assembly 40 is illustrated in its normally closed position. Hex head member 42 is threaded into bore 12-1 in rotor casing 12 and coacts with O-ring 44 to provide a seal. Member 42 has a bore 42-1, a bore 42-2, an annular recess 42-3 and a flange portion 42-4. The valve body is made up of members 50, 52 and 54. Member 50 has a threaded bore 50-1, a plurality of circumferentially spaced slots 50-2 and an annular flange 50-3. Member 54 has a threaded bore section 54-1, a smooth bore section 54-2, a valve seat 54-3, a valve port 54-5, flange portion 54-6 and annular groove 54-7 in flange portion 54-6. O-ring 60 is located in groove 54-7 and normally seals against flange 42-4. Because neither flange 50-3 nor flange 54-6 can pass through bore 42-2, they must be located on opposite sides of member 42 for assembly. Connection of members 50 and 54 is through annular connector 52 which has a threaded portion 52-1 which is threadedly receivable in threaded bores 50-1 and 54-1 and has a central bore 52-2.

There are various sequences for assembling members 50, 52 and 54 together. Valve disk 56 and spring 57 must be in bores 54-1/54-2 before member 52 is threaded into bore 54-1. Spring 58 must be in bore 42-1/annular recess 42-3 prior to member 52 being threaded into both of threaded bores 50-1 and 54-1. Member 52 serves four functions: (1) it serves to connect members 50 and 54; (2) it serves as a spring seat for spring 57; (3) it adjusts the bias of spring 57; and (4) forms a portion of the relief flow path when valve disk 56 is unseated.

In the FIG. 2 position of valve member 40, all of the valves are closed, member 54 extends into the discharge chamber D and valve disk 56 is exposed to discharge chamber pressure over the area of port 54-5. The other side of valve disk 56 is exposed to suction chamber pressure and the bias of stiff spring 57 which may exert a biasing force equivalent to several hundred psi on valve disk 56 tending to keep it closed. Light spring 58 has a biasing force on the order of one to six psi and is located between flange 50-3 and annular recess 42-3. Spring 58 in conjunction with the discharge pressure acting on member 54 and valve disk 56 tends to keep the integral valve body made up of members 50, 52 and 54 in place and is opposed by the net suction pressure acting on members 50, 54 and valve disk 56.

Figure 3:
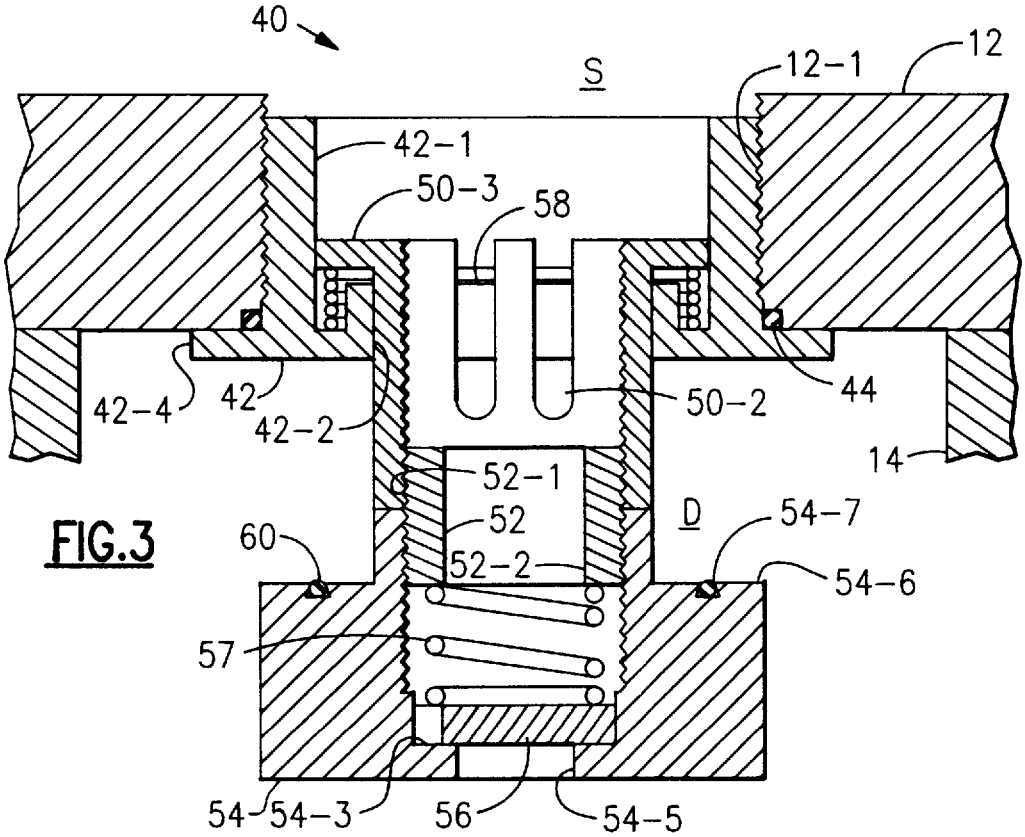
FIG. 3 is a sectional view of the valve structure showing the reverse rotation triggered opening of the valve.

When there is a higher pressure in the suction chamber than in the discharge chamber, as during reverse operation, the pressure differential acting across the valve body made up of members 50, 52, 54 and valve disk 56 will cause the unseating of flange 54-6 from flange 42-4 under a nominal pressure differential of a few psi. FIG. 3 illustrates the position of valve member 40 when it is opened responsive to reverse operation. The fluid path from the higher pressure suction chamber to the lower pressure discharge chamber will serially be bore 42-1, bore 50-1 and slots 50-2.

Figure 4:
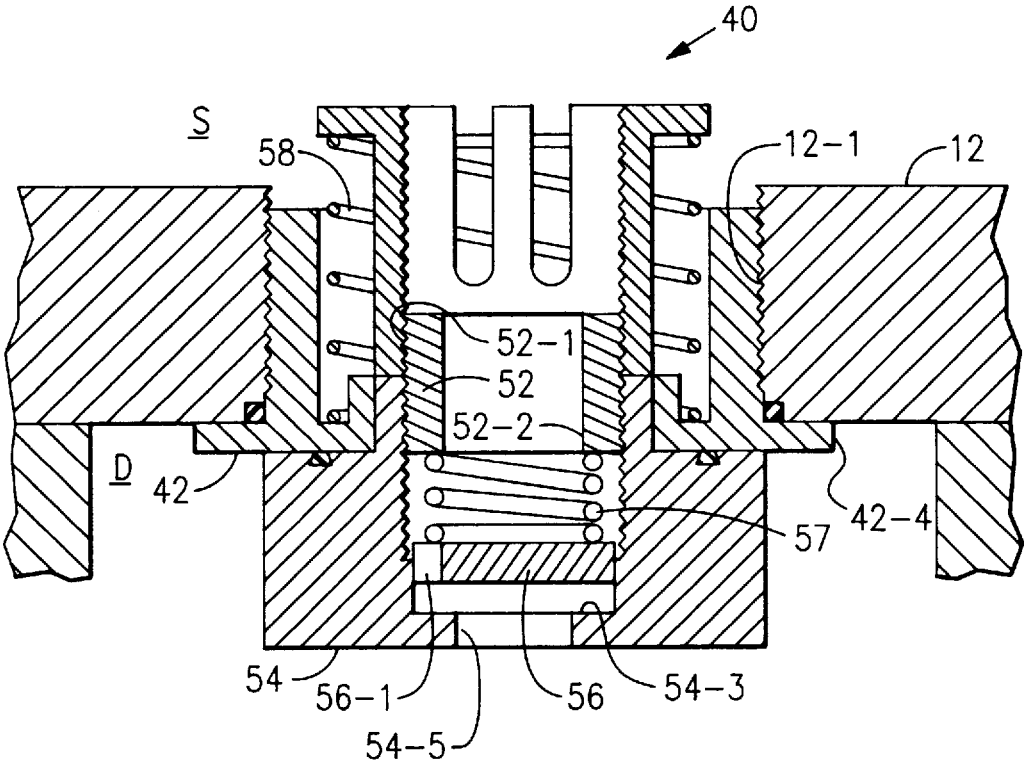
FIG. 4 is a sectional view of the valve structure showing the relief valve open.
Figure 5:
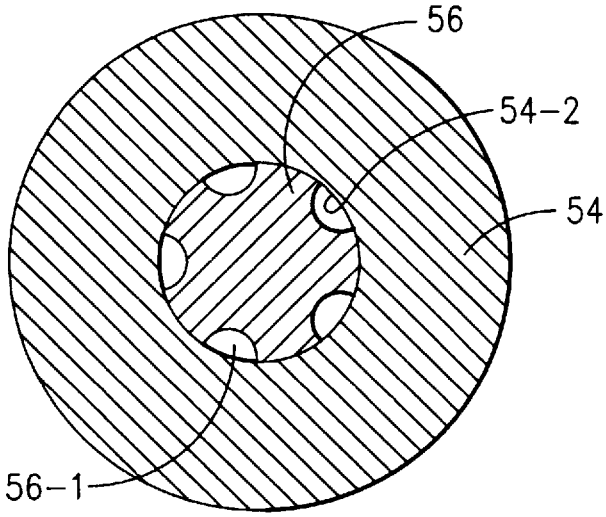
FIG. 5 is a sectional view taken along line 5—5 of FIG. 2.

When the pressure in the discharge chamber exceeds the desired discharge pressure, this pressure acting on valve disk 56 will cause valve disk 56 to unseat against the stiff bias of spring 57 and the suction pressure acting on the opposing side of valve disk 56. FIG. 4 illustrates valve disk 56 unseated responsive to excess discharge pressure. When valve disk 56 is unseated a fluid path between the discharge and suction chambers will be established serially including valve port 54-5, bore 54-2, grooves 56-1 in valve disk 56, bore 54-1 bore 52-2, bore 50-1 and slots 50-2.

Although a preferred embodiment of the present invention has been illustrated and described, other changes will occur to those skilled in the art. It is therefore intended that the present invention is to be limited only by the scope of the appended claims.

What is claimed is:

1. In a compressor having a suction plenum and a discharge plenum a combination valve comprising:

a passage connecting said suction and discharge plenums;

a first member having a bore and sealingly secured in said passage;

a valve body located in said bore and movable from a first position blocking flow between said suction plenum and said discharge plenum to a second position permitting flow from said suction plenum to said discharge plenum when said suction plenum is at a higher pressure than said discharge plenum;

means for biasing said valve body to said first position by providing a light bias tending to keep said valve body in said first position, whereby said valve body is moved to said second position due to said suction plenum being at a higher pressure than said discharge plenum.

2. The combination valve of claim 1 further including:

a relief valve in said valve body;

means for biasing said relief valve closed by providing a stiff bias to said relief valve whereby when pressure in said discharge plenum exceeds said stiff bias said relief valve is opened and communication is established between said discharge chamber and said suction chamber.

3. The combination valve of claim 2 wherein said valve body is made up of three separate members secured together as an integral unit.

4. The combination valve of claim 3 wherein said three separate members includes two members having threaded bores and a third member having a threaded portion receivable in said threaded bores in said two members whereby an integral unit is achieved.

5. The combination of claim 4 wherein said third member threading into said threaded bore of one of said two members adjusts said means for biasing said relief valve.

6. The combination valve of claim 1 wherein said valve body is made up of three separate members secured together as an integral unit.

7. The combination valve of claim 6 wherein said three separate members includes two members having threaded bores and a third member having a threaded portion receivable in said threaded bores in said two members whereby an integral unit is achieved.

8. In a compressor having a suction plenum and a discharge plenum and pump structure for drawing gas at suction pressure from said suction plenum and for delivering gas at discharge pressure to said discharge plenum, a combination valve comprising:

a passage bypassing said pump structure and connecting said suction and discharge plenums;

a first member having a bore and sealingly secured in said passage;

a valve body located in said bore and movable from a first position blocking flow between said suction plenum and said discharge plenum to a second position permitting flow from said suction plenum to said discharge plenum when said suction plenum is at a higher pressure than said discharge plenum;

a relief valve in said valve body;

means for biasing said valve body to said first position by providing a light bias tending to keep said valve body in said first position, whereby said valve body is moved to said second position due to said suction plenum being at a higher pressure than said discharge plenum; and means for biasing said relief valve closed by providing a stiff bias to said relief valve whereby when pressure in said discharge plenum exceeds a value corresponding to said stiff bias, said relief valve is opened and communication is established between said discharge chamber and said suction chamber bypassing said pump structure.

9. The combination valve of claim 8 wherein said valve body is made up of three separate members secured together as an integral unit.

10. The combination valve of claim 9 wherein said three separate members includes two members having threaded bores and a third member having a threaded portion receivable in said threaded bores in said two members whereby an integral unit is achieved.

11. The combination of claim 10 wherein said third member threading into said threaded bore of one of said two members adjusts said means for biasing said relief valve.

* * * * *